United States Patent [19]

Haase et al.

[11] 4,294,350

[45] Oct. 13, 1981

[54] SHOWER PARTY NAME PLATE AND FAVOR

[76] Inventors: Margaret J. Haase; Meredith Hasse, both of 140-25 Donizetti Pl., Apt. 25E; Joan Halle, 140-25 Donizetti Pl., Apt. 25F, all of Bronx, N.Y. 10475

[21] Appl. No.: 125,327

[22] Filed: Feb. 28, 1980

[51] Int. Cl.[3] ..... B65D 77/00

[52] U.S. Cl. ..... 206/216; 40/2 R; 40/606; 40/124.1; 206/259; 229/62

[58] Field of Search ..... 229/62, 63, 8; 40/2 R, 40/10 R, 124.1; 206/216, 259, 257

[56] References Cited

U.S. PATENT DOCUMENTS

| | | | |
|---|---|---|---|
| 1,261,297 | 4/1918 | Rummler | 40/124.1 X |
| 1,379,739 | 5/1921 | Bennett | 40/124.1 |
| 2,501,314 | 3/1950 | Catozella | 40/124.1 |
| 3,235,986 | 2/1966 | Blish | 40/2 R |

*Primary Examiner*—Gene Mancene
*Assistant Examiner*—Wenceslao J. Contreras
*Attorney, Agent, or Firm*—Richard L. Miller

[57] ABSTRACT

A novelty for use at a party, and which serves as a nameplate and favor; the novelty including a piece of mesh fabric in which a small quantity of nuts or candy are wrapped, and the fabric is then tied closed by a bow of rick-rack tape which also wraps around a handle of a cardboard model of an umbrella on which a person's name or a greeting is written.

1 Claim, 4 Drawing Figures

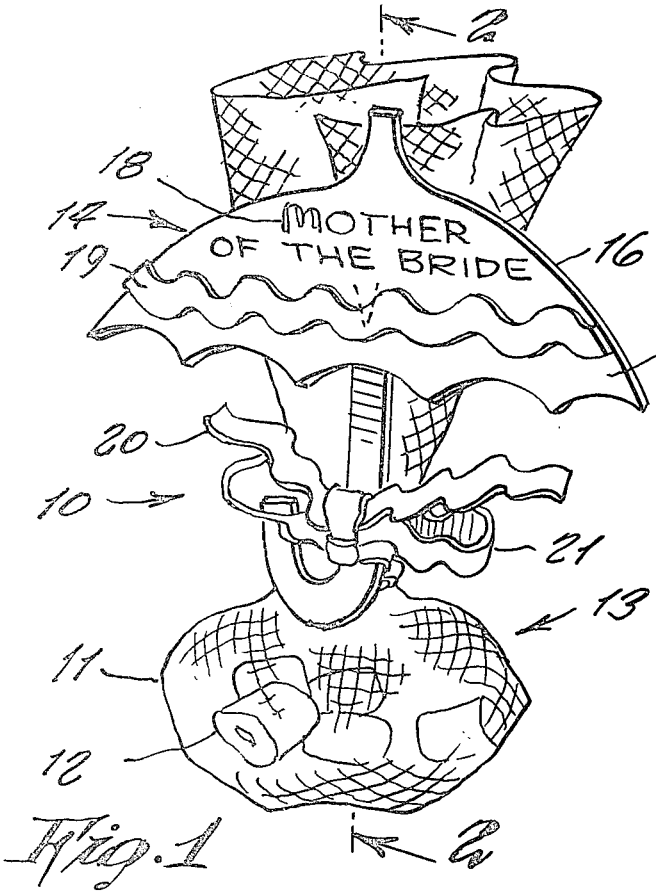
Fig. 1
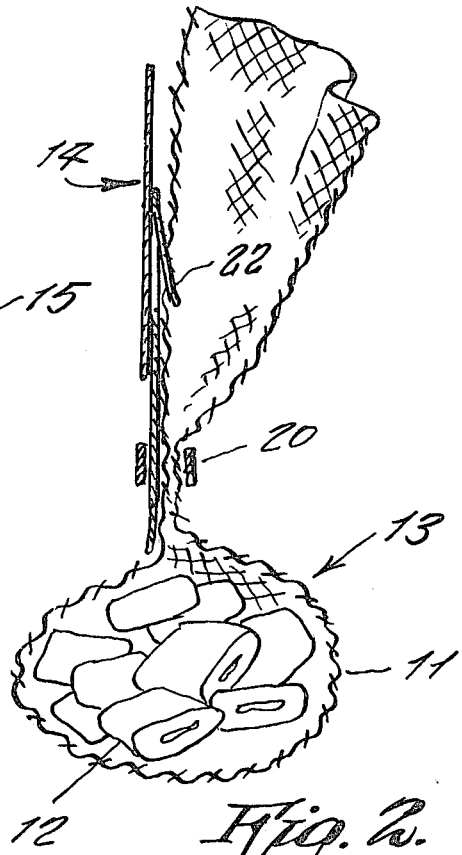
Fig. 2.
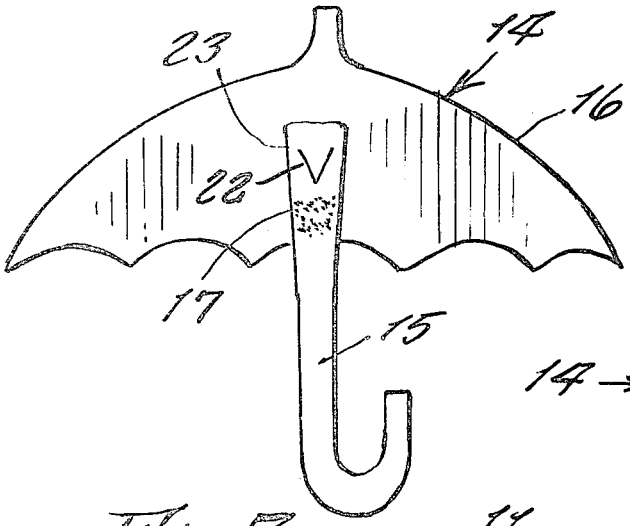
Fig. 3
Fig. 4
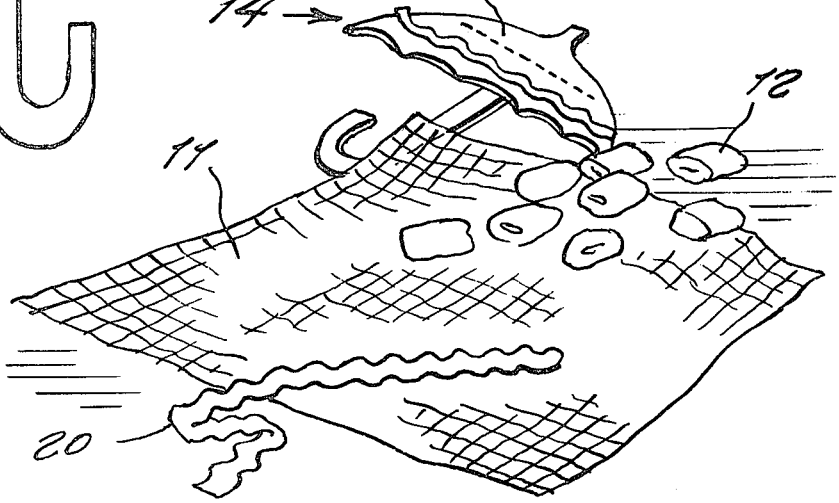

SHOWER PARTY NAME PLATE AND FAVOR

BACKGROUND OF THE INVENTION

This invention relates generally to party nameplates and favors.

It is well known that numerous designs of nameplates have been designed in the past for the seating of guests at a party dining table. Likewise numerous containers have been developed for holding party favors, but is not believed that there has been developed a combination thereof that has the particular appeal of the present invention.

SUMMARY OF THE INVENTION

A principal object of the present invention is to provide a combination nameplate and favor which is designed particularly for use at a special party, such as that of a shower party for a bride or the like, and wherein the device includes a nameplate that is shaped so as to suit the specific occasion that is being celebrated.

Another object is to provide a party nameplate and favor which is attractive in appearance and which can be quickly and easily manufactured so that it is a profitable article of production to a manufacturer.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a front perspective view of the invention.

FIG. 2 is a cross sectional view on line 2—2 of FIG. 1.

FIG. 3 is a rear elevational view of the umbrella decoration.

FIG. 4 is a perspective view of the invention components prior to assemblying together.

DETAILED DESCRIPTION OF PREFERRED EMBODIMENT

Referring now to the drawing in greater detail, the reference numeral 10 represents a shower party nameplate and favor according to the present invention, wherein there is a small rectangular piece of mesh fabric 11 such as curtain material and upon which there is placed a small quantity of candy or nuts 12 such as almonds or the like and which is then wrapped up in the fabric so as to form a party favor 13.

The present invention also includes a nameplate 14 that is tied to the favor and which serves to identify a seating arrangement for the quests at the party dining table.

The nameplate is made on cardboard 15 that is die-cut around its edge 16 so that it is in a shape that relates to the party occasion. Thus in the example that is illustrated in the drawing, the nameplate is in the shape of an umbrella and for specific use at a bride's shower party. For other kinds of parties, such as birthdays, commencements, anniversaries or the like, the nameplate might be appropriately die-cut so as to form some object that relates to the occasion.

As shown in the drawing, the nameplate representing an umbrella for a shower party, is comprised of a handle component 15 and a canopy component 16 which are attached together by means of an adhesive 17. A greeting 18 may be imprinted on a front side of the canopy component and which also may include a space 18*a* where a guest's name may be written. A decorative band 19 either made of a rick-rack tape or printed pictorally to represent the same, is made also on the canopy for decoration purpose.

After the candy and/or nuts are placed on the fabric 11, the farbic corners are lifted and brought together so that the fabric forms a bag containing the favor candy or nuts. The gathered portion of the fabric is then tied to the umbrella handle component 15 by means of a length of rick-rack tape 20 that is then also tied into an attractive bow 21. The umbrella is made to stand erect by means of a spur 22 die-cut into an un-adhered upper end tab 23 of the handle component 15, the spur being hooked into the fabric mesh of the upstanding corners of the gathered fabric. Thus the fabric mesh holds the umbrella upright.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A party nameplate and favor comprising, a bag made of a flexible mesh fabric that is easily collapsible, said bag designed to hold candy and the like; a nameplate of cardboard affixed to said bag, said nameplate comprising a shape having a handle portion and a decorative portion affixed to said handle portion, said handle portion having a spur for engagement with said mesh bag; said handle portion and said decorative portion being arranged in an overlap formation such that the overlapping portions of each are attached to each other and a portion of the overlapped portion of said handle portion having said spur thereon, that portion of said handle portion comprising said spur being free from permanent bonding with said decorative portion; means for tying said handle portion to said bag at that portion of said handle portion remote from the overlapping portion thereof, said means for tying also serving to close off said bag after the candy and the like have been inserted therein; said spur of said handle portion being inserted through the mesh of said bag after said means for tying has secured the candy and the like therein, whereby the nameplate is held erect for easy viewing and whereby the candy and the like is stored in a visual display to serve as a party favor.

* * * * *